US007059336B2

(12) United States Patent
Höser et al.

(10) Patent No.: US 7,059,336 B2
(45) Date of Patent: Jun. 13, 2006

(54) CLEANING DEVICE FOR A SHAVING HEAD OF A DRY SHAVING APPARATUS

(75) Inventors: Jürgen Höser, Neu Anspach (DE); Diana Kappes, Eppstein (DE); Andreas Larscheid, Kelkheim-Fischbach (DE); Uwe Ludäscher, Frankfurt (DE); Svatopluk Krumnikl, Kronberg (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/935,847

(22) Filed: Sep. 8, 2004

(65) Prior Publication Data

US 2005/0045204 A1 Mar. 3, 2005

Related U.S. Application Data

(63) Continuation of application No. PCT/EP02/12888, filed on Nov. 18, 2002.

(30) Foreign Application Priority Data

Mar. 8, 2002 (DE) ..... 102 10 349

(51) Int. Cl.
*B08B 3/00* (2006.01)

(52) U.S. Cl. ..... 134/92; 134/135; 134/201; 134/166 R; 134/133; 134/111; 134/186

(58) Field of Classification Search ..... 134/133, 134/166 R, 114, 135
See application file for complete search history.

(56) References Cited

U.S. PATENT DOCUMENTS

| | | | | |
|---|---|---|---|---|
| 3,910,298 | A * | 10/1975 | Shotmeyer | 137/1 |
| 4,269,236 | A * | 5/1981 | Fogg | 141/293 |
| 4,707,865 | A * | 11/1987 | Ludwig et al. | 4/227.4 |
| 4,763,805 | A * | 8/1988 | Strock | 220/723 |
| 4,838,949 | A * | 6/1989 | Dugrot | 134/32 |
| 5,033,492 | A * | 7/1991 | Mertens et al. | 134/166 R |
| 5,365,958 | A * | 11/1994 | Stuhlmacher, II | 134/44 |
| 5,649,556 | A | 7/1997 | Braun | |
| 5,711,328 | A | 1/1998 | Braun | |
| 5,794,635 | A * | 8/1998 | Maines | 134/95.3 |
| 6,131,230 | A * | 10/2000 | Manabat | 15/104.92 |
| 6,263,890 | B1 * | 7/2001 | Hoser | 134/111 |
| 6,305,391 | B1 * | 10/2001 | Hoser | 134/111 |
| 6,371,136 | B1 * | 4/2002 | Hoser | 134/111 |
| 6,626,194 | B1 * | 9/2003 | Wong | 134/102.2 |
| 6,640,819 | B1 * | 11/2003 | Hoser et al. | 134/92 |

FOREIGN PATENT DOCUMENTS

| | | |
|---|---|---|
| DE | 44 02 237 | 3/1995 |
| DE | 44 02 238 | 7/1995 |
| DE | 199 18 287 | 2/2000 |
| FR | 2568111 A1 * | 1/1986 |

* cited by examiner

*Primary Examiner*—Joseph L. Perrin
*Assistant Examiner*—Sarah E. Husband
(74) *Attorney, Agent, or Firm*—Fish & Richardson P.C.

(57) ABSTRACT

A cleaning device for a shaving head of a dry shaving apparatus includes a reservoir to store a cleaning fluid, a receptacle adapted to receive the shaving head and the cleaning fluid, the receptacle being configured to direct the cleaning fluid toward the shaving head, a return conduit extending from the receptacle to the reservoir to convey the cleaning fluid from the receptacle into reservoir; and a venting device attached to the reservoir to provide aeration and deaeration of the reservoir.

11 Claims, 4 Drawing Sheets

CLEANING DEVICE FOR A SHAVING HEAD OF A DRY SHAVING APPARATUS

CROSS-REFERENCE TO RELATED APPLICATIONS

This is a continuation of PCT application Ser. No. PCT/EP02/12888, filed Nov. 18, 2002, which claims priority to German Patent Application No. 102 10 349.6, filed on Mar. 8, 2002, which is incorporated herein by reference in its entirety.

TECHNICAL FIELD

This description relates to a cleaning device for a shaving head of a shaving apparatus, for example, a dry electric shaver.

BACKGROUND

Devices have been developed for cleaning the shaving head of a dry shaving apparatus. For example, German Patent No. DE 44 02 238 A1, which is incorporated herein by reference in its entirety, discloses, a receptacle configured for receiving the shaving head of a dry shaving apparatus. The receptacle is trough-shaped to conform to the contour of the shaving head and fully accommodates the shaving head. The receptacle has an outlet opening and an overflow which lead into a collecting container. The collecting container is connected by a return conduit to the reservoir containing the cleaning fluid. For this purpose the reservoir has a first opening into which the return conduit is inserted and sealed in place. At the beginning of the cleaning cycle the cleaning fluid is propelled by the motor-driven impelling device out of the reservoir through a second opening and by means of a conduit into the receptacle. During the cleaning cycle cleaning fluid is flushed through the receptacle continuously such that the quantity of cleaning fluid which is conveyed into the receptacle flows back through the return conduit into the reservoir.

At the beginning of the cleaning cycle, cleaning fluid is conveyed out of the reservoir into the receptacle. Little or no cleaning fluid flows back into the reservoir until the receptacle is filled as far as the overflow. Hence the fluid level in the reservoir drops. This lowering of the fluid level causes the volume of air in the reservoir to increase, as a result of which the pressure in the reservoir drops. As the pressure in the reservoir is lower than the atmospheric pressure, air flows in through the return conduit which connects the receptacle to the reservoir. Because the cleaning fluid did not completely fill the receptacle at the beginning of the cleaning cycle and during the initial period of the return of the cleaning fluid to the reservoir, the cross section of the return conduit was not completely closed by the returning cleaning fluid, the pressure difference between the reservoir and the surrounding atmosphere is compensated for by the influx of air through the return conduit. Air is admitted to the reservoir. After the receptacle has been filled, the quantity of cleaning fluid supplied to the receptacle flows through the return conduit into the reservoir. This leads, at the latest, after the impelling device is switched off, to a rise of the fluid level in the reservoir and to a corresponding reduction of the air volume, whereupon the air pressure in the reservoir increases to exceed ambient pressure. However, the returning cleaning fluid produces a fluid lock in the return conduit, thus preventing the air in the reservoir from escaping. The air is unable to overcome the resistance of the returning cleaning fluid and cannot escape from the reservoir until a sufficiently high pressure builds up in the reservoir. Accordingly, deaeration of the reservoir is hence delayed and the return of the cleaning fluid is obstructed by the escaping air. These brief interruptions to the return flow of the cleaning fluid result in brief fluid pileups in the receptacle, causing the fluid stream developing in the receptacle to be disturbed. This stream is important for discharging the hair particles dislodged from the shaving head. This disturbance of the fluid stream ultimately obstructs the discharge of hair residues from the receptacle. In some cases the abrupt deaeration of the reservoir is accompanied by noise which can disturb the user of the cleaning device.

SUMMARY

According to one aspect, a cleaning device includes a reservoir and a venting device which allows the cleaning fluid to flow unhindered back into the reservoir. Furthermore, the fluid stream for discharging the hair residues collecting in the receptacle should not be disturbed.

The venting device permits air in the reservoir to escape to ambient when the internal reservoir pressure is too high, without it being disturbed by another medium. The advantage of such a cleaning device is that when the cleaning fluid flows back from the receptacle through the conduit into the reservoir it is no longer obstructed by air escaping from the reservoir and is thus able to flow continuously into the reservoir. At the same time this also prevents the brief fluid pileups in the receptacle, which are responsible for disturbing the fluid stream developing in the receptacle. In one embodiment, the cleaning device promotes the reliable discharge of hair residues from the receptacle into the reservoir. Furthermore, the venting device can allow gradual deaeration of the reservoir. The fast and abrupt escaping of air can be reduced as the deaeration takes place, thereby reducing noise. With the appropriate design the venting device can be used in addition as an aerating device.

In one embodiment the venting device is a vent pipe. The vent pipe can be combined with the return conduit to form one common component.

In a simple construction the vent pipe combines with the return conduit to form a component which is divided by a partition wall into two flow areas. The cross sections of the two flow channels can be identical. Advantageously, however, the flow channel forming the return conduit has a larger cross section than the flow channel forming the vent pipe. The cross sectional shapes of the individual conduits can take any form, e.g., semicircular, rectangular, oval.

To prevent an unintentional escaping of cleaning fluid from the reservoir, the reservoir can have an opening through which the venting device is passed and sealed by a seal.

The lower end of the vent pipe has to be arranged above the maximum fluid level in the reservoir and extend to the outside of the reservoir. The arrangement above the maximum fluid level guarantees reliable deaeration at all times. A venting device of this type is of very straightforward construction and hence characterized by low cost and ease of assembly. For the venting device to work it suffices for the vent pipe to end directly above the upper reservoir wall. With the cleaning device in an inclined position this can result in an escape of cleaning fluid through the vent pipe. In an improved aspect the upper end of the vent pipe above the reservoir is extended, whereby the extension can extend to the level of the receptacle. An extension of the vent pipe reliably prevents the unintentional escaping of cleaning fluid even when the cleaning device is inclined.

The venting device can be integrated in the reservoir containing the cleaning fluid. Renewal of the cleaning fluid at certain intervals means that the reservoir is required as a replacement part in significantly higher numbers than the cleaning device as a whole. Hence a very large number of venting devices will be needed if the venting device is integrated in the reservoir. It is an advantage therefore for the venting device to be fixed on the cleaning device.

In one embodiment the venting device is fastened, by latching hooks, for example, to a chassis plate carrying the chassis of the cleaning device. The venting device can be detachably connected to the chassis plate or made integrally therewith. In the case of a detachable arrangement, suitable latching points are arranged on the venting device and the chassis plate. On the venting device this can take the form of a radially circumferential collar which cooperates with the hooks, for example.

The return conduit from the receptacle into the reservoir for the cleaning fluid already provides a component on the cleaning device which is connected to the reservoir by way of an opening. Another opening in the reservoir for the venting device is avoided if the vent pipe is arranged in the opening for the return conduit. In an advantageous aspect the vent pipe is connected to the return conduit and inserted with it in a shared opening in the reservoir. The advantage of this arrangement is that there is still only one opening to be sealed against an escape of cleaning fluid. The connection of the vent pipe to the return conduit can be effected in a wide variety of ways. The vent pipe and the return conduit can be connected by positive engagement using a latch or clip connection or by material engagement. Connecting the two pipes by means of bars may also be contemplated. In another aspect the two conduits form a common component with a partition wall for division into two flow channels.

In yet another aspect at least a part of the wall of the venting device extends to the bottom of the reservoir. In this case it is possible for a part of the wall of the venting device or a part of the return conduit to be constructed such that a fluid stream conducive to the sedimentation of dirt particles forms in the cleaning fluid flowing back through the return conduit. For this purpose a part of the wall of the venting device can be constructed such that the cleaning fluid can be deflected at an angle, preferably approximately parallel to the bottom of the reservoir, when it leaves the return conduit. Cleaning fluid which impacts vertically on the reservoir bottom can cause turbulence that swirls up any dirt particles which have already settled on the bottom. Through the deflection caused by the wall the cleaning fluid flows parallel, or at a slight angle, to the bottom of the reservoir. A fluid stream thus develops which favors the deposition of those hair residues which were entrained with the cleaning fluid out of the receptacle. The wall section which deflects the cleaning fluid can also be a part of the wall of the return conduit. Deflection of the inflowing cleaning fluid in a direction away from the suction line has proven to be advantageous in effecting the greatest possible deposition of dirt particles and hence keeping the number of particles in the circulated cleaning fluid low.

In another aspect, the cleaning device includes a venting device formed by a venting bore with a small cross section with a diameter of between about 1 mm and 2 mm, in one embodiment the diameter is about 1.5 mm. A venting bore of this type can be arranged, for example, in the seal for the opening through which the return conduit enters the reservoir or in the reservoir wall. Escape of cleaning fluid is reduced or prevented when the diameter of the bore is chosen such that air is allowed to escape but the cleaning fluid is no longer able to on account of its surface tension. Another possibility is for the venting bore to be covered by an air-permeable and liquid-impermeable membrane.

In another aspect the venting device can be constructed as a valve. Valves with a diaphragm as closing element have proven to be particularly favorable as a very low opening pressure of the valve can be set with a diaphragm. Furthermore, the diaphragm has the advantage of closing the opening during the period when no cleaning of the shaving head is being performed. This hinders the evaporation of the cleaning fluid, which contains volatile constituents.

In another aspect, a cleaning device for a shaving head of a dry shaving apparatus includes a reservoir to store a cleaning fluid, a receptacle adapted to receive the shaving head and the cleaning fluid, the receptacle being configured to direct the cleaning fluid toward the shaving head, a return conduit extending from the receptacle to the reservoir to convey the cleaning fluid from the receptacle into reservoir, and a venting device attached to the reservoir.

In another aspect, a cleaning device for a shaving head of a dry shaving apparatus includes a reservoir for storing a cleaning fluid, a receptacle adapted to receive the shaving head and the cleaning fluid, the receptacle being configured to direct the cleaning fluid toward the shaving head, a return conduit extending from the receptacle to the reservoir to convey the cleaning fluid from the receptacle into reservoir, and a vent pipe substantially adjacent the return conduit, the vent pipe being attached to the reservoir.

In another aspect, a shaving system includes the cleaning device of one of the foregoing aspects and a dry shaving apparatus adapted and configured for use with the cleaning device.

In another aspect, a method of cleaning the shaving head of a dry shaving apparatus includes inserting the shaving head into a receptacle, flowing cleaning fluid into the receptacle and toward the shaving head from a storage reservoir, and continuously flowing cleaning fluid from the receptacle into a the storage reservoir, while venting the reservoir to the atmosphere. In one embodiment, the method includes depositing residue from the cleaning fluid substantially uniformly along a bottom surface of the reservoir.

Further objects, features, advantages and application possibilities will become apparent from the description and drawings, and from the claims.

DETAILED DESCRIPTION

Figure 1:
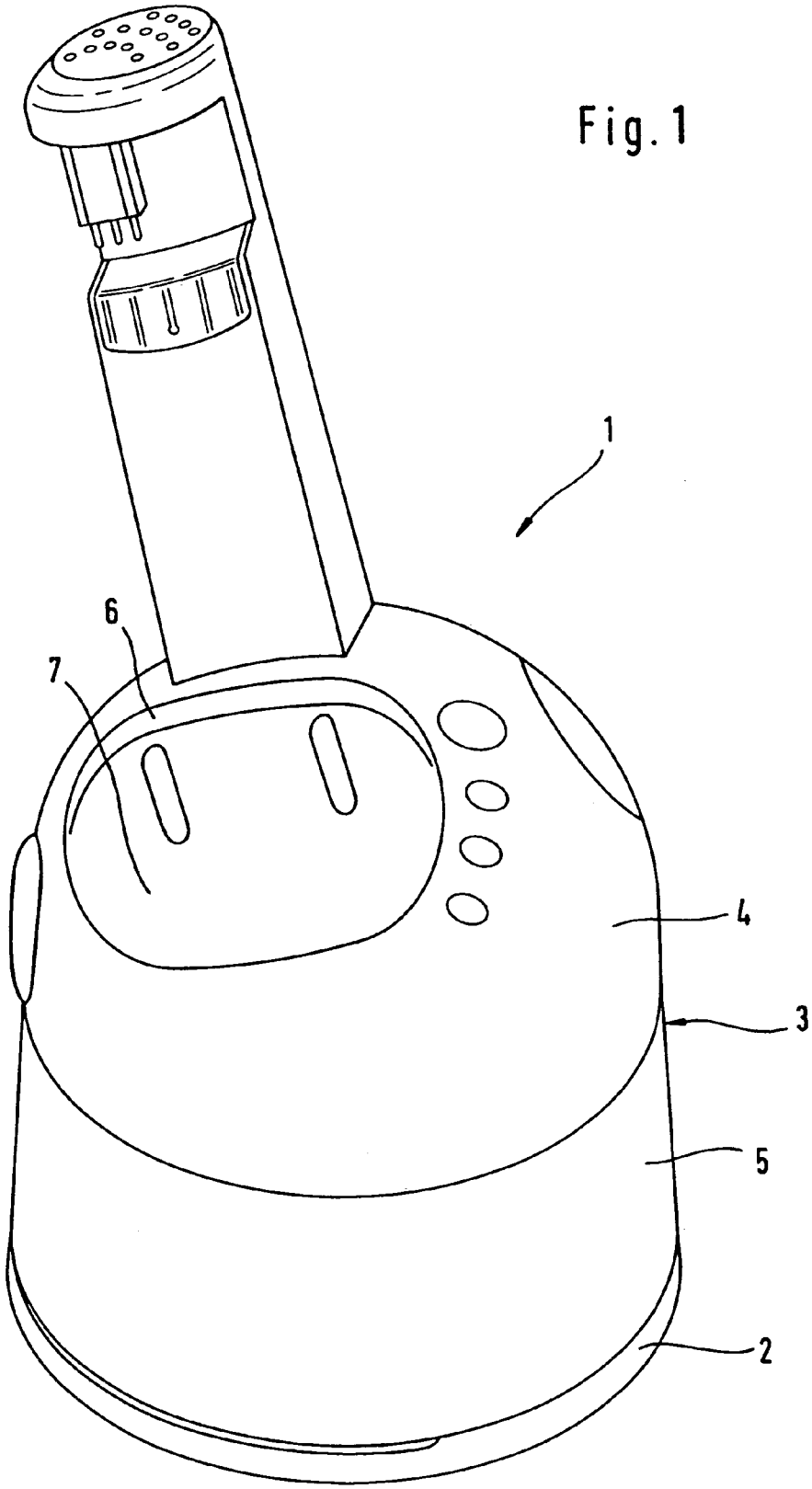
FIG. 1 is a view of a cleaning device.

The cleaning device 1 shown in FIG. 1 includes a bottom plate 2 and a chassis 3. The chassis 3 is composed of two housing parts 4, 5. For cleaning, the shaving head of a dry shaving apparatus, not shown, is inserted into a receptacle 7 through an opening 6 in the housing part 4. Arranged underneath the chassis 3 are the devices needed for cleaning the dry shaving apparatus such as the reservoir and the impelling device for the cleaning fluid.

Figure 2:
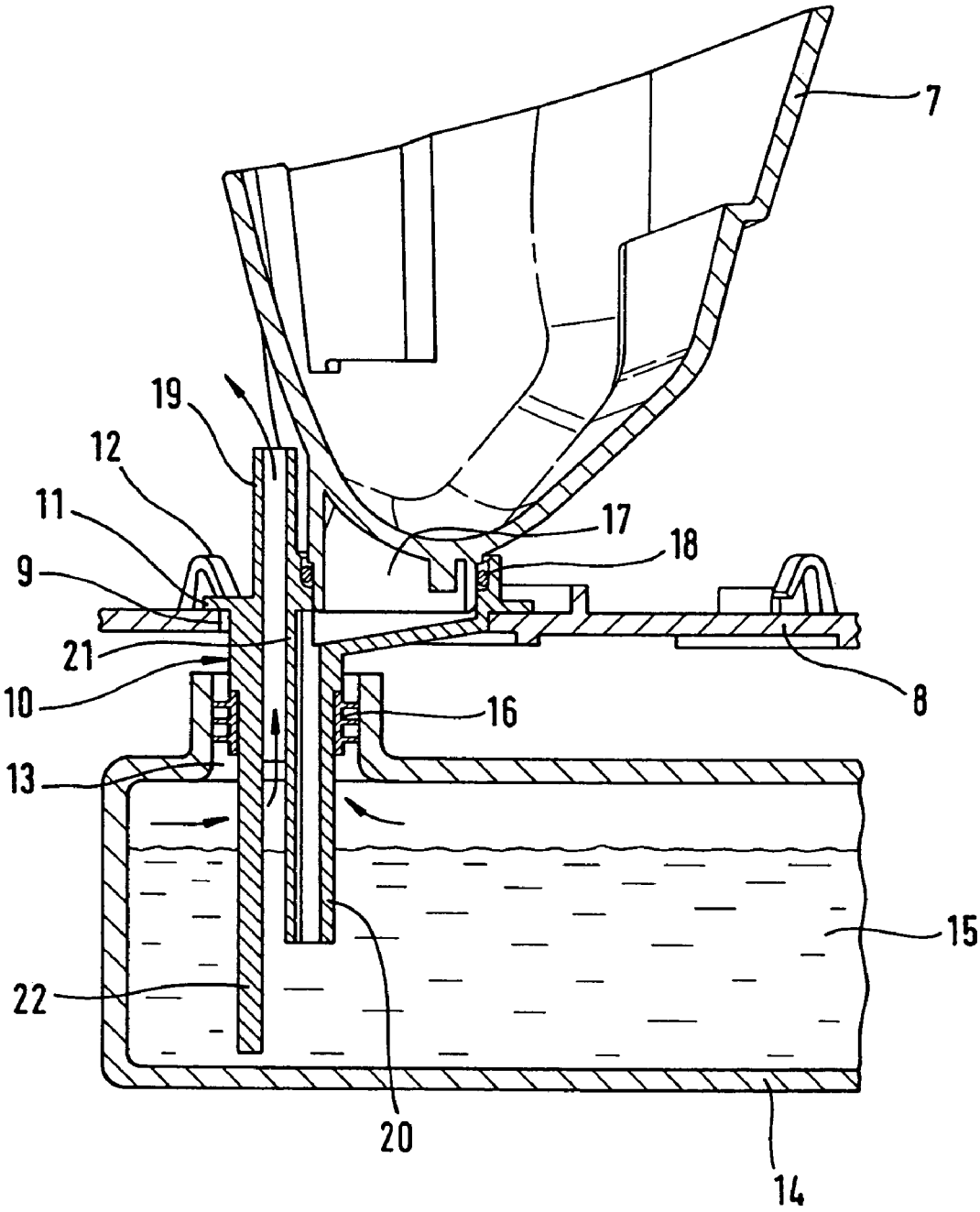
FIG. 2 is a sectional view of a receptacle and a venting device.

The receptacle 7 shown in FIG. 2 is arranged above a chassis plate 8 carrying the chassis 3 (FIG. 1). A venting device 10 is inserted in an opening 9 of the chassis plate 8. The venting device 10 has a collar 11 with which the venting device 10 sits on the opening 9. The venting device 10 is fastened to the chassis plate 8 by hooks 12 arranged on the chassis plate 8 which engage the collar 11. The venting device 10 is inserted in an opening 13 of a reservoir 14 containing acleaning fluid 15.

A lip seal 16 seals the venting device 10 against the opening 13. The receptacle 7 (FIG. 1) has in its lower region an opening 17 into which the venting device 10 is inserted. An O-ring 18 seals this connection.

The venting device 10 comprises a vent pipe 19, which starting from above the maximum fluid level in the reservoir 14, extends up to the level of the receptacle 7. The arrangement of the vent pipe 19 above the maximum fluid level guarantees sufficient venting of the reservoir 14 at all times. The outflowing air is indicated with arrows. The length of the vent pipe 19 reduces the possibility of any cleaning fluid 15 escaping through the vent pipe 19, even with the cleaning device 1 oriented at a significant incline from the horizontal. Together with a return conduit 20 the vent pipe 19 forms a single component with a shared partition wall 21.

The cleaning fluid 15 conveyed into the receptacle 7 in order to clean the shaving head can flow through the return conduit 20 and back into the reservoir 14. A part of the wall 22 of the venting device 10 is extended in downward direction.

Figure 3:
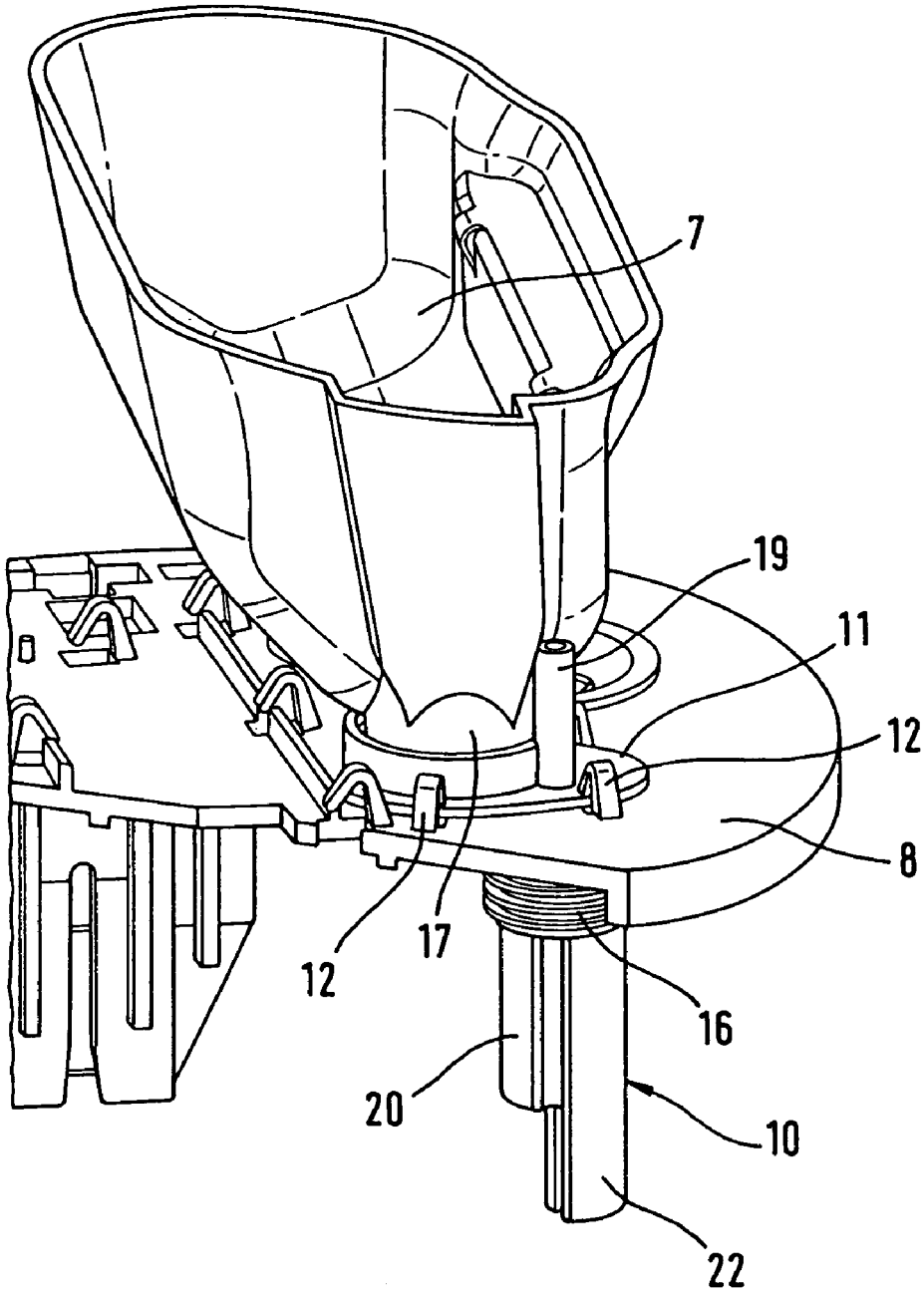
FIG. 3 is a perspective view of the receptacle with the venting device of FIG. 2.

FIG. 3 shows the arrangement of the receptacle 7 above the chassis plate 8. In the area of the opening 17 the receptacle 7 is inserted in the venting device 10. By means of the hooks 12 the venting device 10 is fastened to the chassis plate 8 through its collar 11. The venting device 10 is sealed against the reservoir by a seal, such as a lip seal 16, for example (FIG. 2). The vent pipe 19 is arranged on the side adjacent to the receptacle 7.

Figure 4:
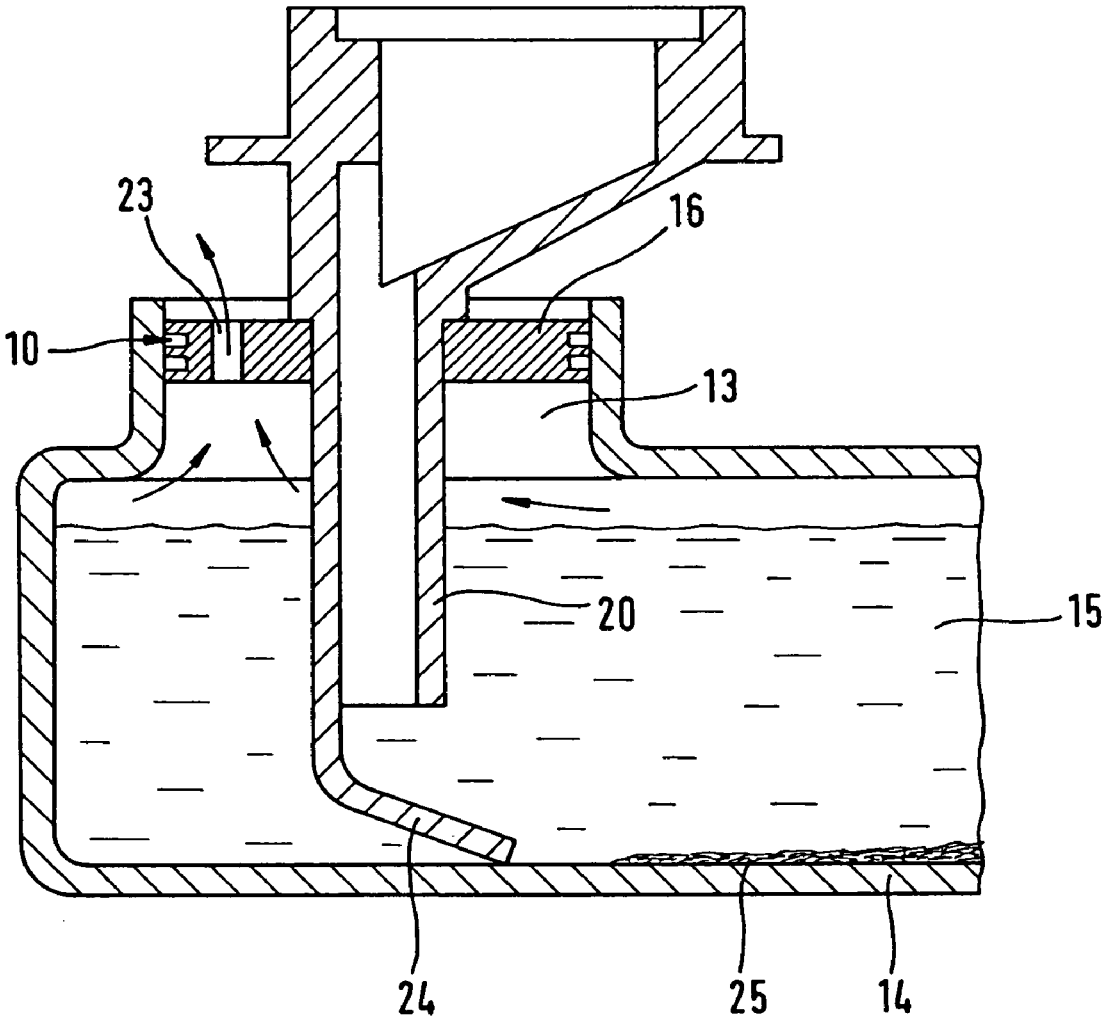
FIG. 4 is a view of a second embodiment of a venting device.

In another embodiment according to FIG. 4 the venting device 10 is a venting bore 23. The venting bore 23 can have a diameter of about 1.5 mm and is arranged in the seal 16 with which the return conduit 20 is sealed against the opening 13 of the reservoir 14. A lower portion of a part 24 of the wall of the return conduit 20 is angled to deflect the returning cleaning fluid 15 and thus promote the deposition of hair residues 25. In one embodiment, the lower portion of part 24 is proximate to or in contact with the bottom surface of the reservoir 14.

The invention claimed is:

1. A cleaning device for a shaving head of a dry shaving apparatus, the device comprising:

a reservoir to store a cleaning fluid;

a receptacle adapted to receive the shaving head and the cleaning fluid, the receptacle being configured to direct the cleaning fluid toward the shaving head; and a venting assembly comprising:

a return conduit extending from the receptacle to the reservoir to convey the cleaning fluid from the receptacle into reservoir, a venting device integrally attached to the return conduit, and a partition wall, disposed between the return conduit and the venting device, substantially dividing the assembly into venting and return flow regions, wherein at least a portion of the venting device extends to a bottom surface of the reservoir.

2. The cleaning device of claim 1 wherein the venting device comprises a vent pipe.

3. The cleaning device of claim 2 wherein a lower end of the vent pipe is disposed above a maximum fluid level in the reservoir.

4. The cleaning device of claim 2 wherein an upper end of the vent pipe extends beyond a portion of the receptacle.

5. The cleaning device of claim 1 wherein the reservoir comprises:

an opening for receiving the venting device; and a seal for substantially sealing the venting device to the reservoir.

6. The cleaning device of claim 1, further comprising a chassis plate, the venting device being attached to the chassis plate.

7. The cleaning device of claim 6, wherein the venting device further comprises latching points to attach the venting device to the chassis plate.

8. The cleaning device of claim 7 wherein the latching points comprise a radially protruding, circumferential collar.

9. The cleaning device of claim 1 wherein the portion of the wall extending to the bottom surface of the reservoir is configured to develop a fluid flow pattern in a return flow of the cleaning fluid back through the return conduit conducive to the deposition of dirt particles.

10. A cleaning device for a shaving head of a dry shaving apparatus, the device comprising:

a reservoir for storing a cleaning fluid;

a receptacle adapted to receive the shaving head and the cleaning fluid, the receptacle being configured to direct the cleaning fluid toward the shaving head;

a return conduit extending from the receptacle to the reservoir to convey the cleaning fluid from the receptacle into reservoir;

a vent pipe substantially adjacent the return conduit, the vent pipe being attached to the reservoir; and a partition wall, disposed between the return conduit and the venting pipe, substantially dividing the assembly into venting and return flow regions, at least a portion of the vent pipe extending to a bottom surface of the reservoir.

11. A shaving system comprising:

the cleaning device of claim 1; and a dry shaving apparatus adapted and configured for use with the cleaning device.

* * * * *